US006527609B1

(12) United States Patent
Rowland et al.

(10) Patent No.: US 6,527,609 B1
(45) Date of Patent: Mar. 4, 2003

(54) DOLL HOUSE

(75) Inventors: Pleasant T. Rowland, Middleton, WI (US); Larissa Winterhalter, Cambridge, WI (US); Carol Moretti, Madison, WI (US)

(73) Assignee: Pleasant Company, Middleton, WI (US)

( * ) Notice: Subject to any disclaimer, the term of this patent is extended or adjusted under 35 U.S.C. 154(b) by 0 days.

(21) Appl. No.: 10/008,682

(22) Filed: Dec. 4, 2001

Related U.S. Application Data

(60) Provisional application No. 60/307,500, filed on Jul. 24, 2001.

(51) Int. Cl.[7] ..... A63H 3/52

(52) U.S. Cl. ..... 446/110; 446/478

(58) Field of Search ..... 446/110, 92, 108, 446/476, 478, 487

(56) References Cited

U.S. PATENT DOCUMENTS

| | | | | |
|---|---|---|---|---|
| D156,001 | S | 11/1949 | Haynes | |
| 2,760,275 | A | 8/1956 | Stein | |
| 2,951,311 | A | 9/1960 | Luther | |
| 3,664,055 | A | 5/1972 | Bass et al. | |
| 3,955,307 | A | 5/1976 | Payton | |
| 3,996,693 | A | 12/1976 | Walmer | |
| 4,018,001 | A | 4/1977 | Walmer | |
| D246,932 | S | 1/1978 | Nelson | |
| 4,077,152 | A | 3/1978 | Newsom et al. | |
| 4,143,931 | A | 3/1979 | Skare et al. | |
| 4,146,284 | A | 3/1979 | Mann | |
| 4,195,437 | A | 4/1980 | Ace | |
| 4,203,053 | A | 5/1980 | Shepard | |
| 4,227,336 | A | 10/1980 | Misterka | |
| 4,272,908 | A | 6/1981 | Bassetti et al. | |
| 4,306,371 | A | 12/1981 | Walmer et al. | |
| 4,319,424 | A | 3/1982 | Goldfarb et al. | |
| 4,462,066 | A | 7/1984 | Gibson et al. | |
| 4,723,820 | A | 2/1988 | Kroneck | |
| 4,883,443 | A | 11/1989 | Chase | |
| 5,004,445 | A | 4/1991 | Coleman et al. | |
| 5,011,446 | A | 4/1991 | Feinberg | |
| 5,120,262 | A | 6/1992 | Caine | |
| 5,216,794 | A | 6/1993 | Signumd | |
| 5,423,709 | A | 6/1995 | Summers | |
| 5,562,520 | A | * 10/1996 | Pridonoff et al. | 446/148 |
| 5,827,103 | A | 10/1998 | Carter | |
| 5,830,031 | A | 11/1998 | O'Brien et al. | |
| 6,283,819 | B1 | * 9/2001 | Polinger et al. | 446/478 |

* cited by examiner

*Primary Examiner*—Jacob K. Ackun
(74) *Attorney, Agent, or Firm*—Mark Montague; Cowan, Liebowitz & Latman

(57) ABSTRACT

A doll house includes a modular, box-like structure having a floor, a top surface, a rear wall, two side walls and an open front. Wall panels are provided with two surfaces with different designs thereon and each wall panel can be installed to fully cover a respective wall of the structure. Either surface of a panel can be provided to be visible, and the wall panels can be removed from the walls and re-installed with different surfaces revealed. Similarly, ceiling and floor panels each with two surfaces having different designs can be installed on the floor and top surface, respectively. A front dust cover can be placed over the open front. The doll house may be used with stacking pins to enable for the stacking of multiple modules.

23 Claims, 15 Drawing Sheets

DOLL HOUSE

RELATED APPLICATION

This application claims the benefit of U.S. Provisional Application No. 60/307,500, filed Jul. 24, 2001. The disclosure of U.S. Provisional Application No. 60/307,500 is incorporated herein by reference.

FIELD OF THE INVENTION

The present invention relates to a doll house and, more particularly, to a doll house having separate, modular rooms for design.

BACKGROUND OF THE INVENTION

Numerous types of doll houses have been designed and enjoyed by children and adults. Doll houses come in a variety of designs and are decorated in a variety of manners. Various doll houses, such as that shown in U.S. Pat. No. 5,423,709, are designed to be foldable and portable. Some doll houses, such as that shown in U.S. Pat. No. 5,120,262, are designed to include storage compartments for doll house furniture and accessories. Often, doll houses are designed to allow the user to paint its various components to further aid in the education and enjoyment by use. U.S. Pat. No. 5,011,446 even provides for a doll house with a transparent external assembly to readily enable drawings to be displayed on or in the doll house. Moreover, doll houses come in a variety of shapes and may constitute a single decorated room or multiple rooms. Numerous other doll house features also exist. However, there are many advantageous features and designs of doll houses that have not yet been contemplated.

OBJECTS OF THE INVENTION

Therefore, it is an object of the present invention to provide a doll house with features that are not included in existing designs.

Another object of the present invention is to provide a doll house with a particular design that facilitates the easy replacement of wall coverings, such as wall paper.

A further object of the present invention is to provide a doll house with an advanced electrification system.

An additional object of this invention is to provide a doll house with a uniquely removable front cover.

Still another object of the present invention is to provide a doll house having a unique, modular design to facilitate the easy addition of rooms on top of one another safely and conveniently.

Various other objects, advantages and features of the present invention will become readily apparent to those of ordinary skill in the art, and the novel features will be particularly pointed out in the appended claims.

SUMMARY OF THE INVENTION

In accordance with the present invention, a doll house includes a box-like structure having a floor and a top surface, and a rear and two side walls, with the structure having an open front. Wall panels are provided with each wall panel including first and second surfaces having different designs thereon. Each wall panel is adapted to be releasably retained by and to substantially fully cover a respective one of the rear and two side walls, and also is adapted to be installed with either of the surfaces revealed.

As an aspect of the present invention, the first surface of each wall panel has the same first design thereon, and the second surface of each wall panel also has the same second design thereon, and the first and second designs are different.

As a further aspect of the present invention, a magnetic sheet is fixed to each of the rear and side walls, and wall panel is made of a material that is magnetically attracted to a magnetic sheet.

As another aspect of the present invention, a ceiling panel is provided with first and second surfaces having different designs thereon, and the ceiling panel is adapted to be releasably retained by and to substantially fully cover the ceiling (i.e., the underside of the top surface), and also is adapted so that it can be installed to reveal either of its surfaces.

As a feature of this aspect, the two surfaces of the ceiling panel have the same designs as the first and second surfaces of at least one of the wall panels.

As another feature, a ceiling fixture can be mounted to the underside of the top surface and, when mounted, the ceiling fixture extends downward from the top surface and through an aperture in the ceiling panel.

As a further feature, two magnetic sheets are fixed to the top surface and disposed on opposite sides of the ceiling fixture, and the ceiling panel is made of a material that is magnetically attracted to the two magnetic sheets.

As an additional feature, the ceiling fixture includes a relatively flat contact end that contacts the top surface when mounted, and the contact end of the ceiling fixture is retained by the ceiling panel around the ceiling panel's aperture.

As yet a further aspect of the present invention, the doll house includes a floor panel with two surfaces having different designs thereon, and the floor panel is adapted to be positioned on and to substantially fully cover the floor. The floor panel can be installed to reveal either of its two surfaces.

As yet another aspect of the present invention, the floor and rear panels include a tab to enable their removal from the floor and rear wall, respectively. As still yet a further aspect of the present invention, the floor and top surface of the doll house are trapezoidal in shape with their respective smaller dimensions being at the rear wall, and the two side walls have sloped top edges that slope downward toward the rear wall so that the top surface also slopes downward towards the rear wall.

As still yet another aspect of the present invention, electrical outlets are disposed in the floor, and the floor is a printed circuit board that provides a supplied source of power to each of the electrical outlets.

As a feature of this aspect, the rear wall of the doll house is comprised of a back wall and a false wall with a gap between them, an electrical outlet is disposed in the top surface, and an electrical connection is provided that extends from the printed circuit board through the gap between the back and false walls to the top surface's electrical outlet.

As still yet an additional aspect of the present invention, a protective front cover is provided that can be installed over the open front of the doll house. The protective front cover has a frame with magnetic components installed therein, and the side walls of the doll house have magnetic components installed near the open front at positions that correspond to positions at which the magnetic components are installed in the protective front cover's frame. The magnetic components in the frame are attracted to the magnetic components in the side walls so that the front cover is retained when mounted.

In accordance with another embodiment of the present invention, a doll house includes a box-like module having a floor, a top surface, a rear wall, two side walls and an open front. The floor and top surface are trapezoidal in shape with their respective smaller dimensions being at the rear wall, and each side wall has a sloped top edge that slopes downward towards the rear wall so that the top surface also slopes downward towards the rear wall. The doll house also includes a pair of stacking pins that can be removably connected to the top of the top surface near the rear wall to enable the mounting of a second module having a level floor on top of the doll house.

As an aspect of this embodiment, two or more modules can be installed on top of the first module using stacking pins.

As another aspect, a drawer unit can be mounted on top of the doll house using the stacking pins.

As a further aspect, the drawer unit can be mounted below the doll house.

As an additional aspect, ball feet including the stacking pins can be utilized as feet for the doll house by installing a ball foot with a stacking pin at each bottom corner of the doll house.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE INVENTION

Figure 1:
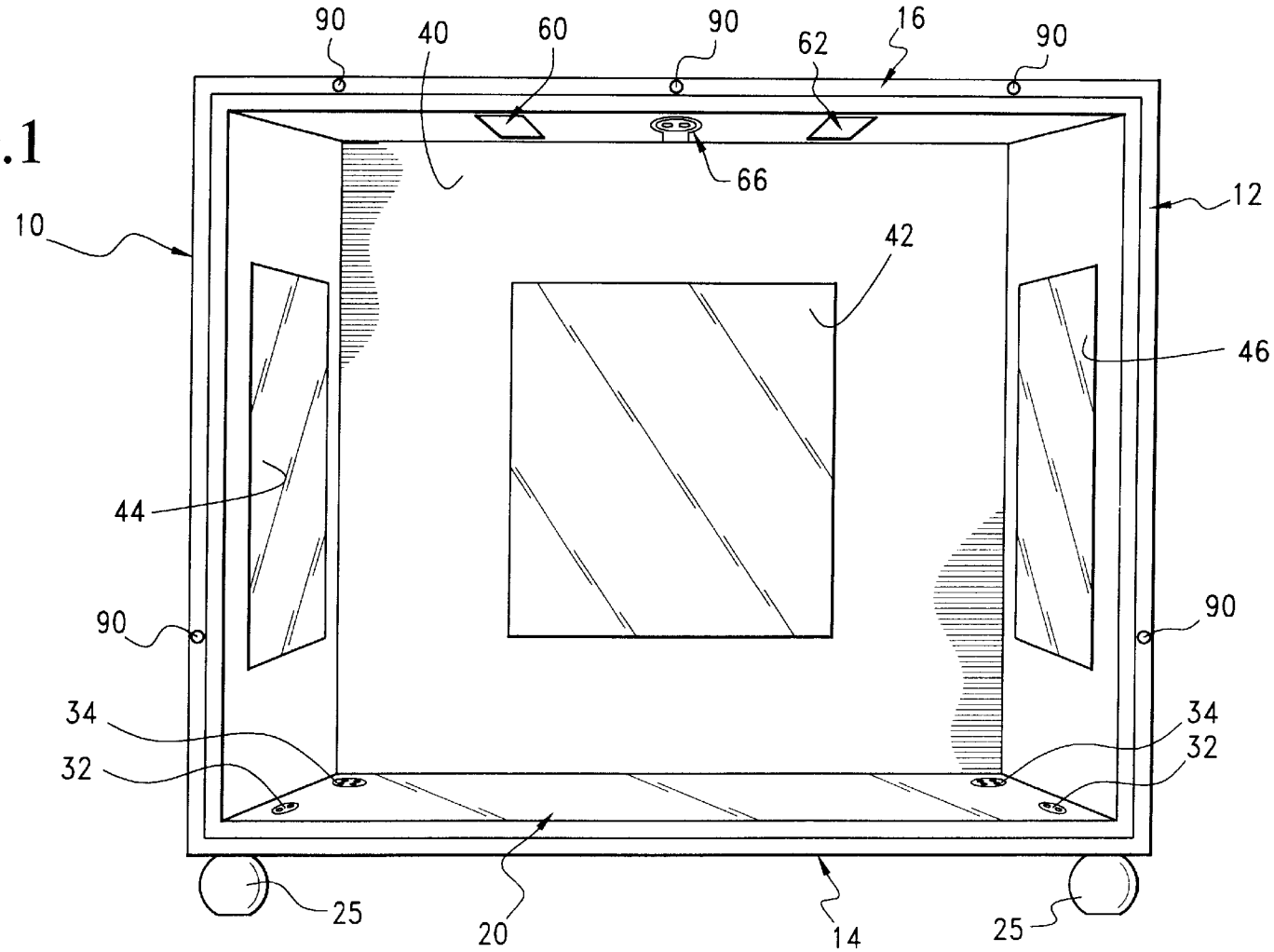
FIG. 1 is a schematic illustration of a front view of the doll house of the present invention.

Referring to the drawings, FIG. 1 schematically illustrates a front view of an embodiment of the doll house of the present invention. As shown, the doll house (also called room) has a modular design and includes left and right side walls 10 and 12, bottom and top surfaces 14 and 16, and a rear wall 18 (false wall 40 shown in FIG. 1; rear wall 18 shown in FIG. 2). Both bottom and top surfaces 14 and 16 have a trapezoid shape for better viewing of the side walls of the doll house, and top surface 16 slopes downward towards the back of the doll house for better viewing of the doll house's internal ceiling, which is better illustrated in the side view shown in FIG. 2.

A printed circuit board 20 (PCB or board 20) (fully described below) is disposed on top of and flush with bottom surface 14, and a surface cover 22, preferably made of paper, is permanently affixed to the top surface of board 20. The doll house optionally includes a set of four feet 25 disposed along the four bottom corners of the doll house (front left and front right feet shown in FIG. 1; and front left and rear left shown in FIG. 2). Feet 25, in addition to aesthetic purposes, enables the stacking feature of the present invention, discussed below.

Figure 3:
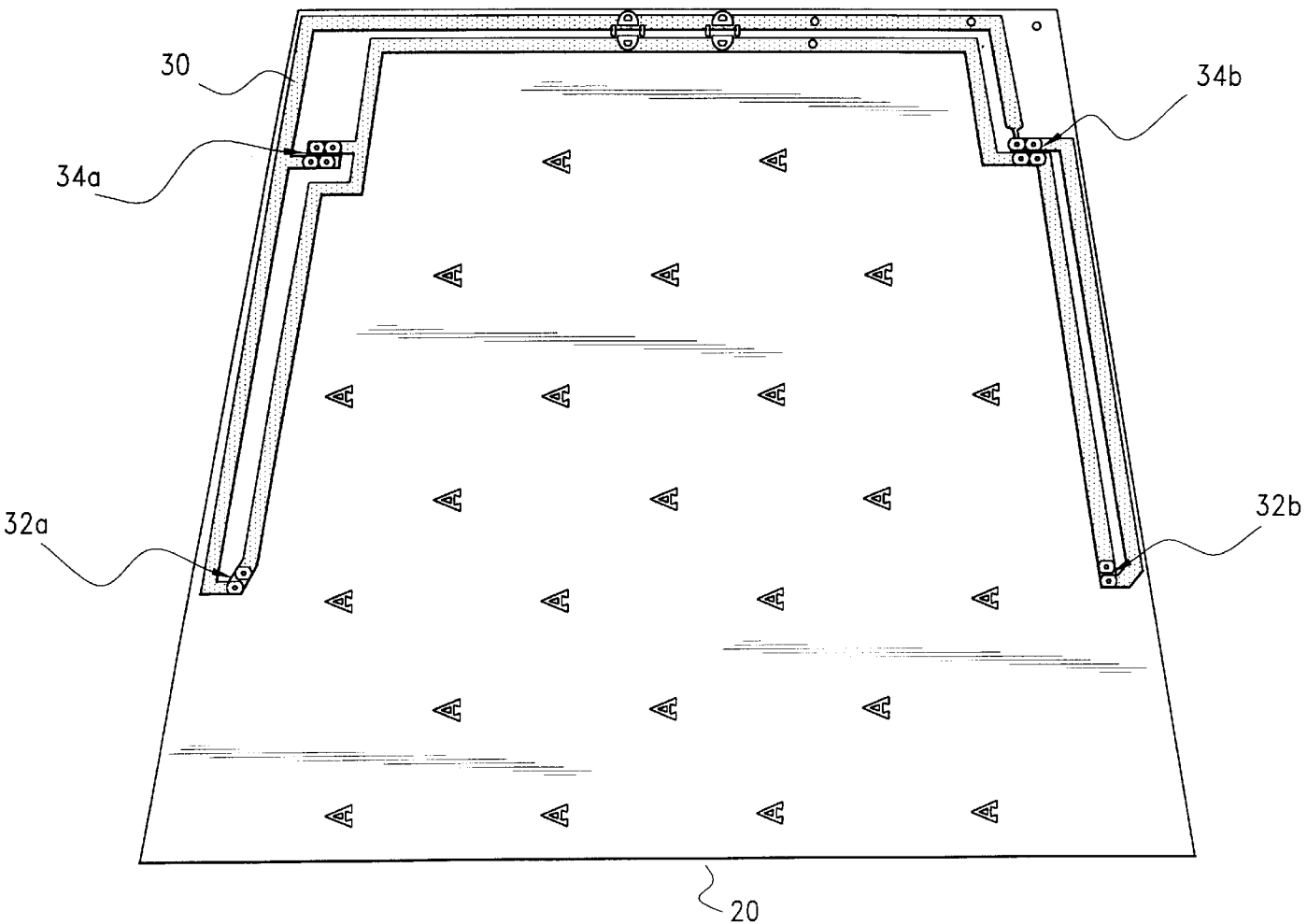
FIGS. 3 and 4 schematically illustrate bottom and top views, respectively, of the printed circuit board floor of the doll house of the present invention.
Figure 4:
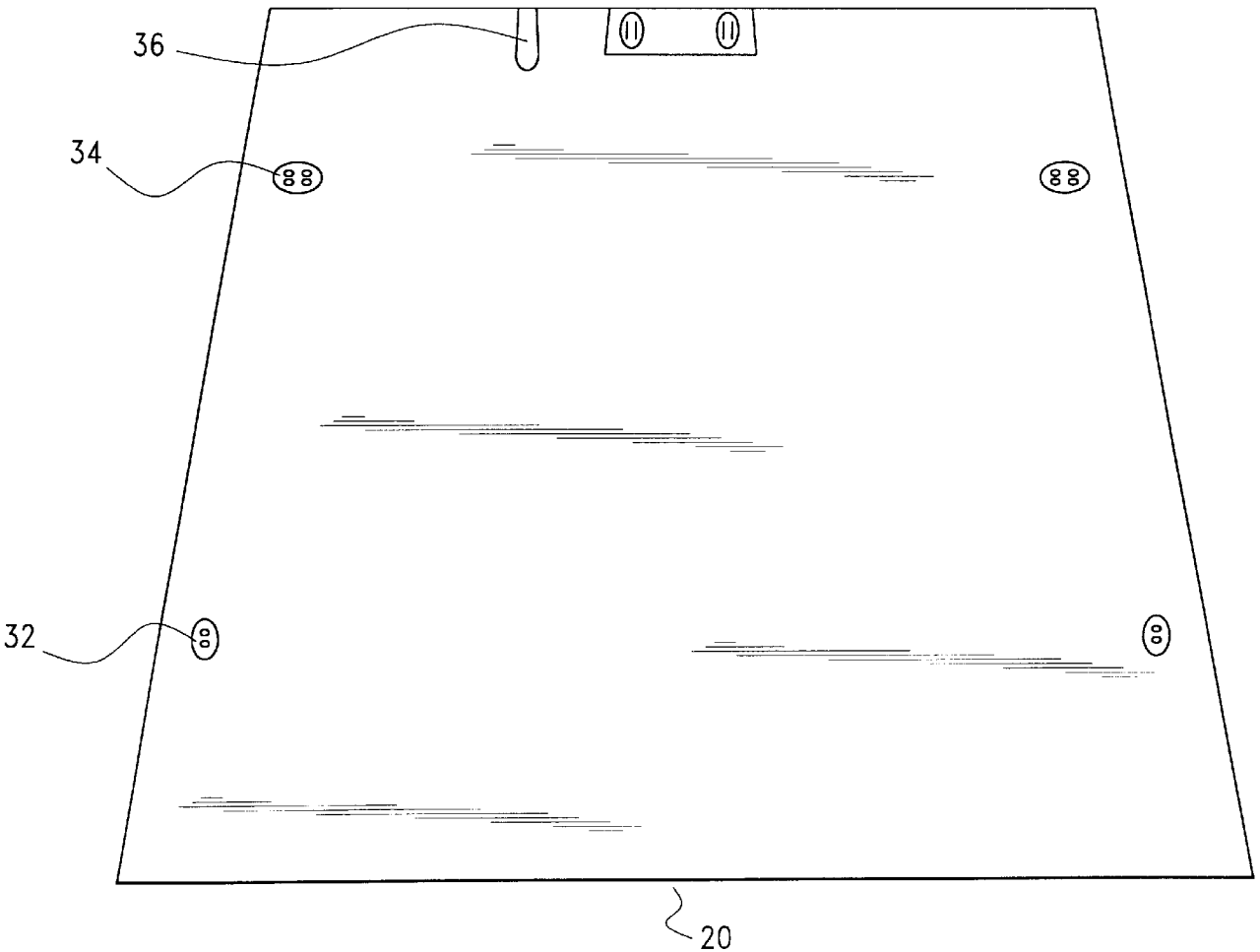

The electrical components of the doll house of the present invention include previously mentioned board 20, a power jack 24, wiring 26 that extends from the power jack, and a ceiling printed circuit board 28 (ceiling board 28). These components enable the electrification of the doll house of the present invention upon connection of a power source, which is generally a low voltage source, to power jack 24. FIGS. 3 and 4 schematically illustrate bottom and top views, respectively, of printed circuit board 20. Power jack 24 is soldered or otherwise coupled to board 20 in a manner known in the art. A power source (not shown) may be connected to power jack 24 to supply power to the circuit board. A second power jack 25 is shown attached to board 20 to provide an output source of power for purposes of powering additional doll house modules (to be discussed below). Board 20 supplies power via the printed circuit 30 to each of the outlets 32, 34 installed in board 20. In the exemplary embodiment shown, two sets of front outlets 32 and two sets of rear outlets 34 are installed in board 20, with such installation being carried out in any manner known, such as by soldering the front and rear outlets (e.g., solder joints 32*a*, 34*b* shown) to the printed circuit board 20. Of course, any number of front and rear outlets may be provided.

Figure 2:
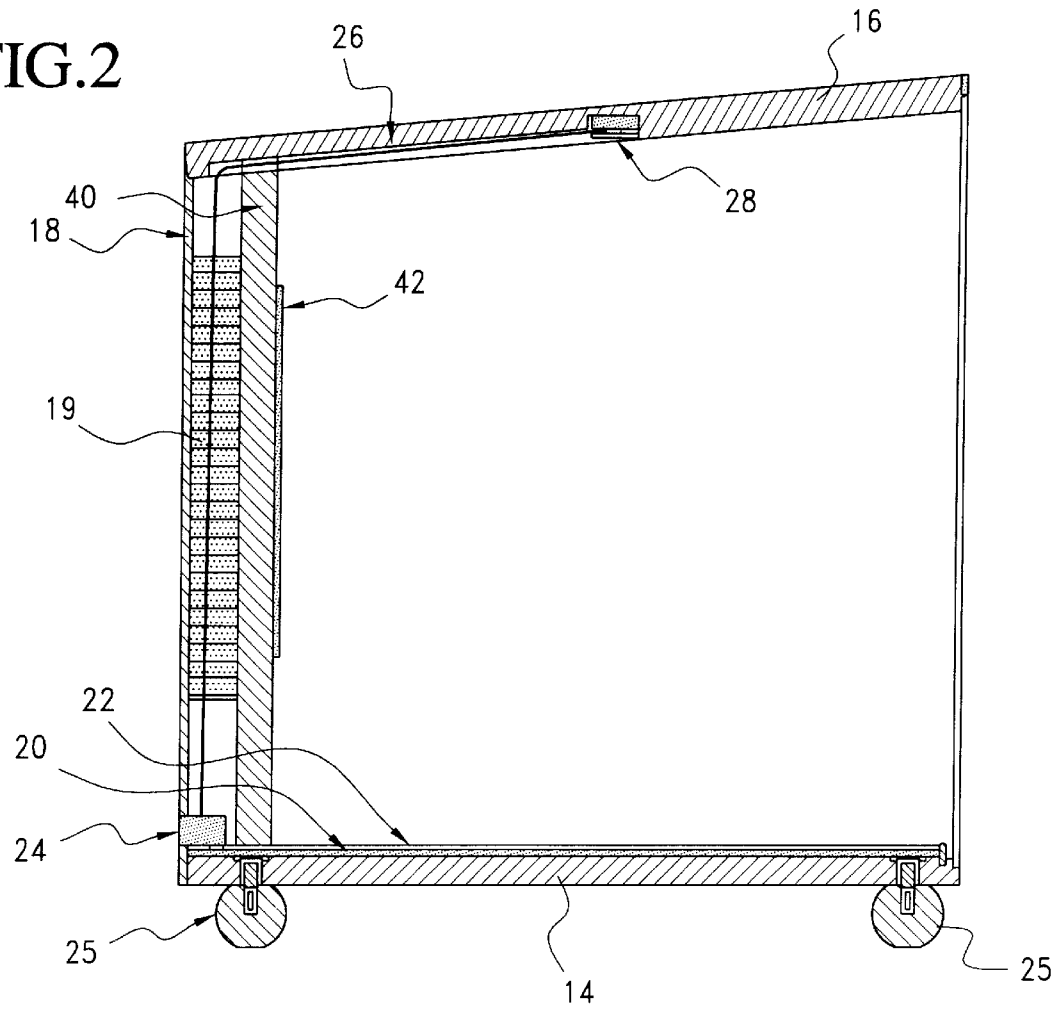
FIG. 2 is a cross-sectional side view of the doll house of the present invention.

Board 20 further includes a solder connection 36 to the previously mentioned wiring 26. As shown in FIG. 2, wiring 26 extends along the back of the doll house between rear wall 18 and false wall 40 (to be discussed) towards the doll house's top surface 16, and then across to ceiling board 28 for the purpose of supplying power to ceiling board 28. As discussed below, ceiling board 28 enables a ceiling fixture, such as a ceiling light or fan, to be connected and powered by the doll house of the present invention.

Figure 5:
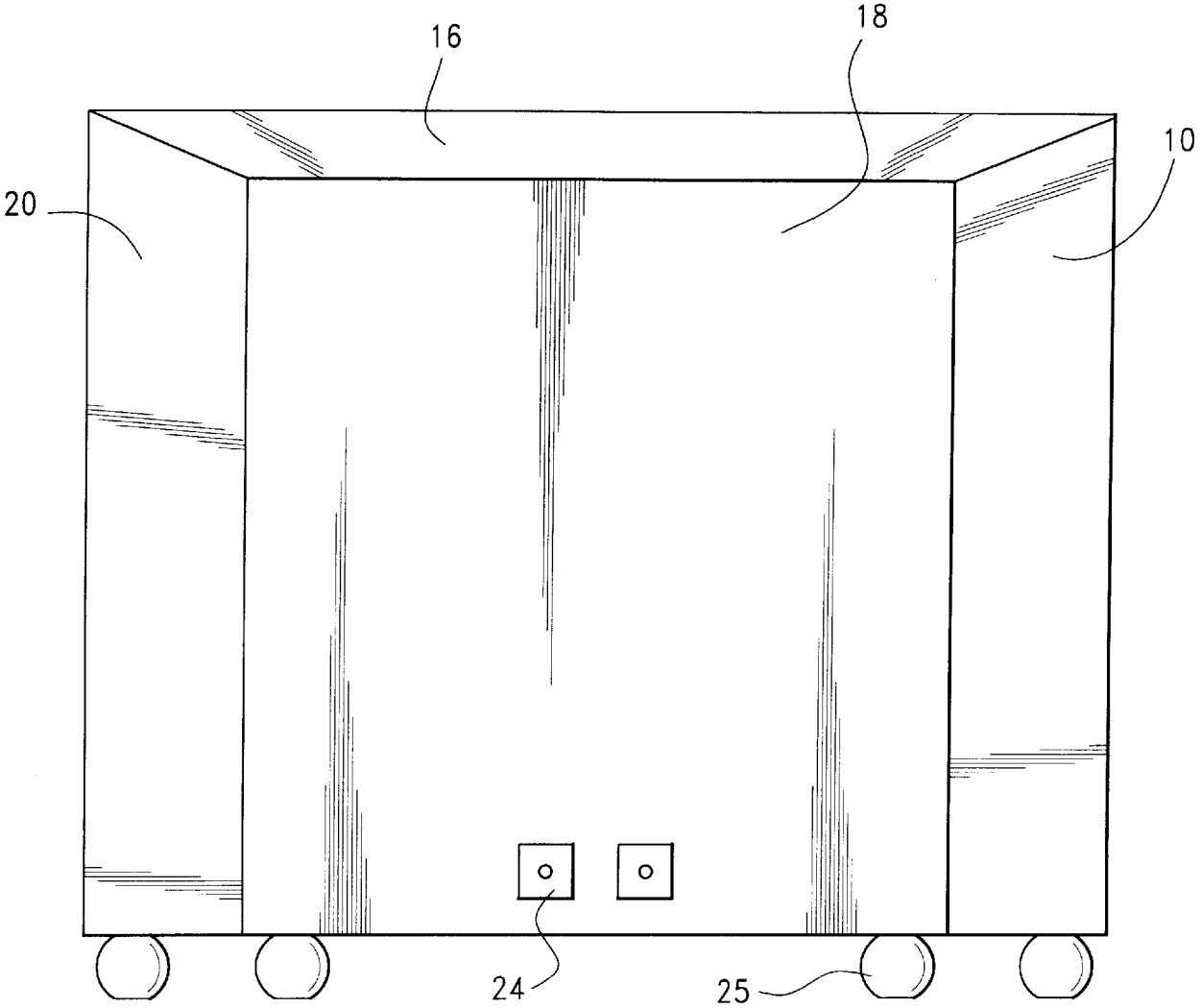
FIG. 5 is a rear view of the doll house of the present invention.

As previously mentioned, printed circuit board 20 is disposed on top of the doll house's bottom surface 14, as shown in FIG. 1. Rear wall 18 includes two appropriately sized and positioned apertures (not shown) through which power jacks 24 and 25 (which are coupled to the rear of board 20; FIG. 4) are disposed, such as shown in the back view of FIG. 5. Cover 22 is preferably made of paper and is permanently fixed to the surface of board 20, primarily for aesthetic purposes. Front and rear outlets 32 and 34 extend through cover 22 to allow electrical fixtures (e.g., via the fixtures' electrical plugs—to be discussed) to be coupled to the outlets to power the fixtures.

Figure 6:
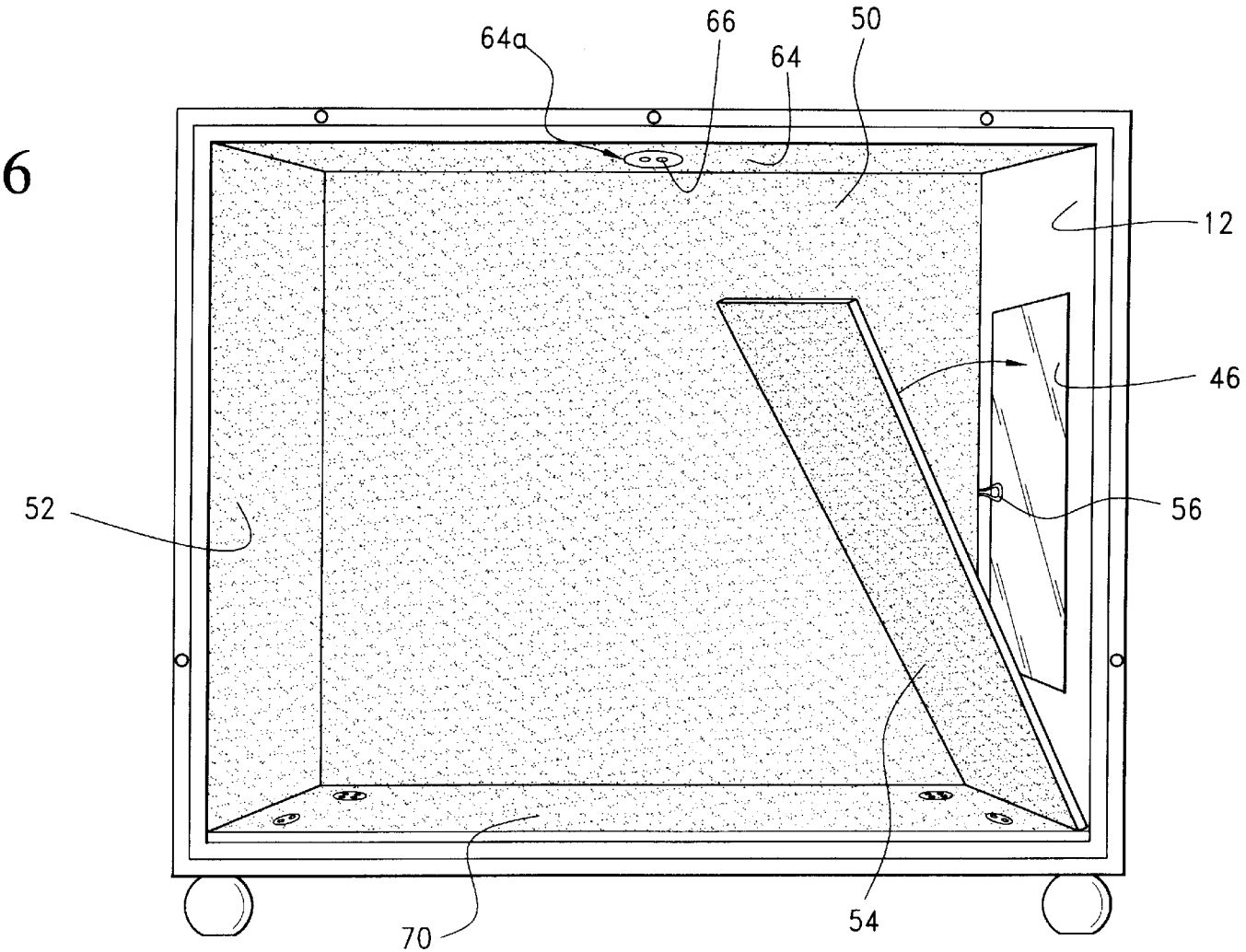
FIG. 6 is another front view of the doll house of the present invention showing how a side panel is installed.

Referring back to FIG. 2, the doll house includes false wall 40 disposed near the rear of the module and is provided to conceal wiring 26. False wall 40 is retained to rear wall 18 by a suitable spacer 19. A magnetic sheet 42, shown in FIGS. 1 and 2, is permanently affixed to false wall 40 and enables a doll house rear panel 50, shown in FIG. 6, to magnetically couple to false wall 40. Similarly, magnetic sheets 44 and 46 are respectively affixed to left and right side walls 10 and 12, as shown in FIG. 1. Side wall panels 52 and 54, shown in FIG. 6, magnetically couple to the two side walls 10 and 12, with FIG. 6 showing side wall panel 54 partially separated from magnet 46 disposed on side wall 12. In accordance with the present invention, side and rear wall panels 50, 52 and 54 are made of any suitable material that are sufficiently attracted to magnetic sheets 42, 44 and 46, with such magnetically attracted panels being provided to enable the doll house user to connect different side and rear panels to the doll house as desired. In the preferred embodiment, each side and rear panel is a thin, firm metal sheet appropriately sized to be magnetically coupled to side and rear walls 10, 12, 40, so that no noticeable gaps exist between the panels and the panels appear to represent the side and rear walls of the doll house of the present invention. Each of the side and rear panels are provided with a tab 56 to enable the user to easily detach the panel from the magnet sheet.

In one exemplary embodiment of the present invention, one surface of each side panel 52 and 54 and rear panel 50 is of the same design, e.g., has the same aesthetic pattern, so that the interior of the doll house represents a single room when such surfaces of the side and rear panels are faced outward when connected to the side and rear walls. Moreover, the other surface of each side panel 52 and 54 and rear panel 50 likewise can have the same design, but different from the first, so that the doll house user can provide a room having a different wall covering design simply by removing the side and rear panels, turning those panels around and attaching their opposite sides to the side and rear walls of the doll house of the present invention. Still further, additional side and rear panels having different designs of their surfaces can be provided and accompany the doll house so that the doll house user can select from a variety of designs. Thus, the present invention enables the user to provide a wall covering for the doll house from a plurality of designs (e.g., "mix and match") in an easy and efficient manner, without the use of any tool and without the need to dissemble the structural components of the doll house (e.g., front, side and rear walls 10, 12, 14, 18, etc.).

Referring back to FIG. 1, top surface 16 includes, embedded within in it or attached in another appropriate manner, two ceiling magnetic sheets 60 and 62. Magnetic sheets 60 and 62 provide a similar functions as magnetic sheets 44 and 46 disposed on the side walls. Namely, ceiling magnetic sheets 60 and 62 retain a ceiling panel 64, shown in FIG. 6, which is made of a suitable material to be magnetically attracted to and retainable by the ceiling magnetic sheets, in a manner similar to how side wall panels 52 and 54 are held. Two magnetic sheets 60 and 62 are shown in the illustrative exemplary embodiment, but one would be sufficient. Ceiling panel 64 may include a first decorative design on one surface and a second decorative design on its other surface, with such designs being the same or different from the designs on the two surfaces of each of the side and rear wall panels. For example, the reversible ceiling panel can emulate a painted ceiling, a paneled ceiling, stucco and so on.

Top surface 16 further includes ceiling printed circuit board 28 embedded within it, as previously discussed, and a ceiling outlet 66 disposed within the ceiling printed circuit board provides a source of electrical power to a ceiling fixture hanging from the center of top surface 16. Ceiling panel 64 contains an aperture 64*a,* shown in FIG. 6, to expose ceiling outlet 66.

Figure 7:
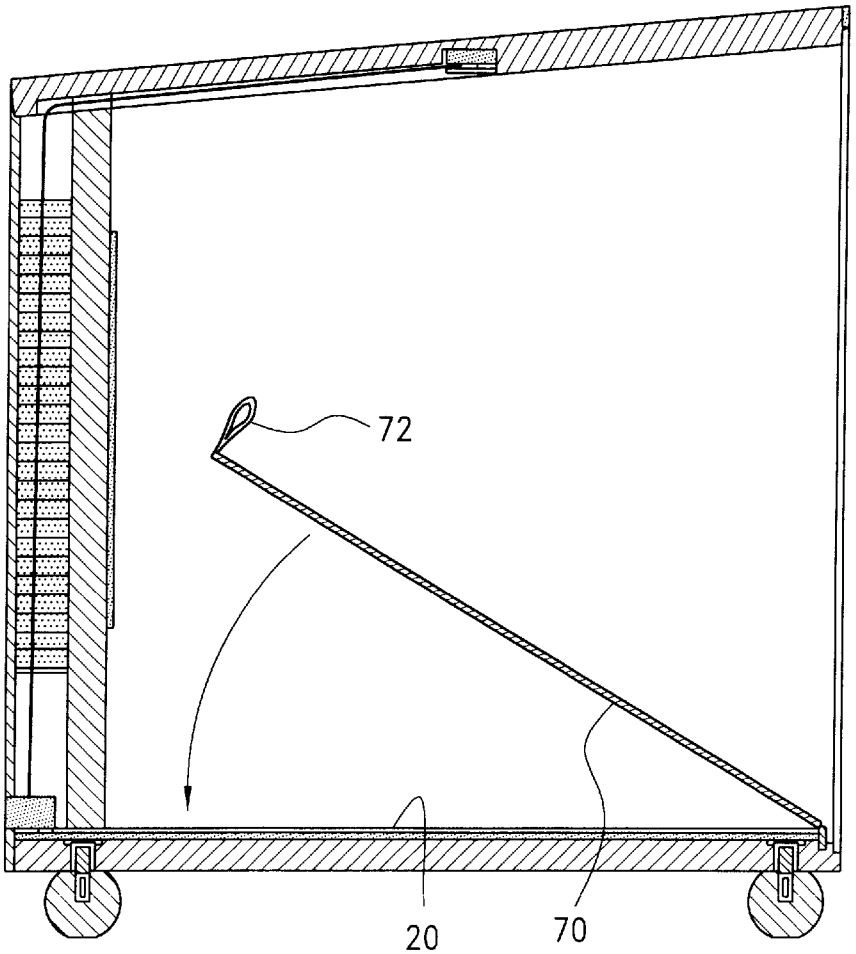
FIG. 7 is a cross-sectional side view of the doll house of the present invention showing how a floor panel is installed.

A floor panel 70, shown in FIGS. 6 and 7, is freely disposed on top of printed circuit board 20, and includes appropriately sized and positioned apertures to expose all of the front and rear outlets 32 and 34. Similar to side and rear panels 50, 52, 54, floor panel 70 include a first decorative floor design on one surface and a second decorative floor design on its other surface, with such designs being the same or different from the designs on the two surfaces of the other discussed panels. For a more realistic aesthetic appearance, floor panel 70 includes designs that emulate various floors, such as wood floors, tiled floors, etc. Moreover, floor panel 70 includes a tab 72, shown in FIG. 7, to enable the floor panel to be easily lowered and lifted.

Figure 9:
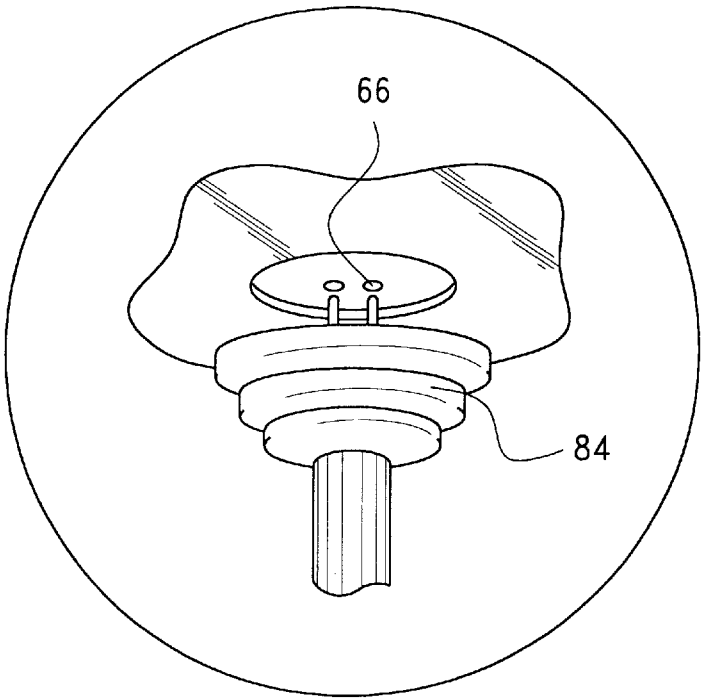
FIG. 9 shows an exemplary plug that may be used with a ceiling fixture that can be inserted into the doll house of the present invention.
Figure 8:
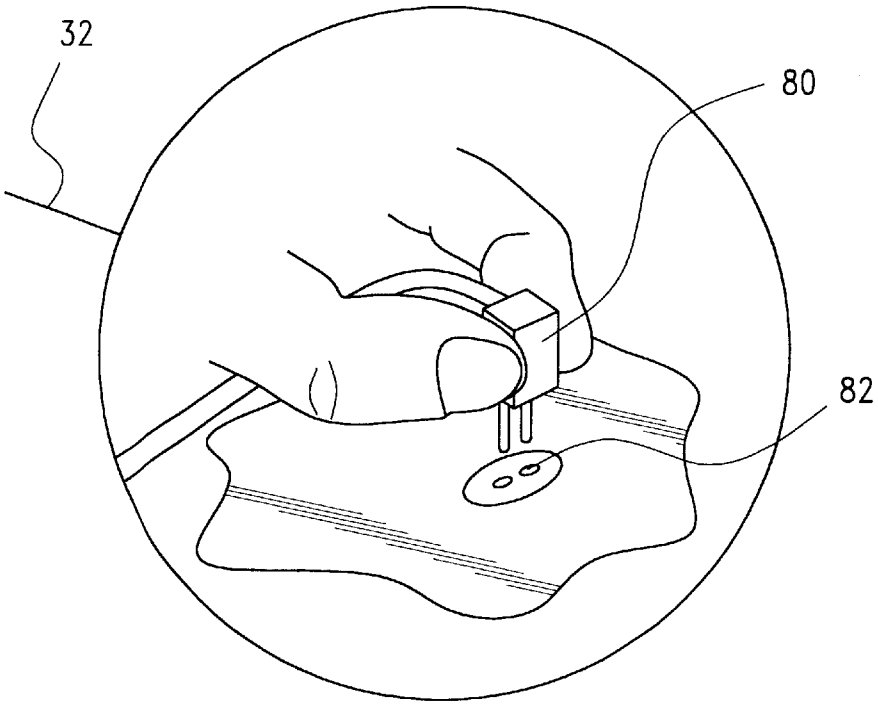
FIG. 8 shows an exemplary plug that may be used with a lamp or other fixture that can inserted into the doll house of the present invention.

FIG. 8 shows a plug 80 of a lamp or other fixture that may be inserted into an outlet 82, which may be any one of the outlets 32, 34, 66 previously discussed. For aesthetic purposes, plug 80 is of the design best suited for insertion into a front outlet 42 or a rear outlet 34, or an outlet disposed within a side wall (not shown). FIG. 9 shows a plug 84 of a ceiling fixture (only partially shown) suited for insertion into ceiling outlet 66. The lamps and fixtures mentioned herein generally are miniaturized versions of typical lamps, fixtures and other electrical devices (e.g., clocks) and their operation and design are well known in the art. The fixtures' plugs are frictionally retained in the outlets, which is also the case for ceiling fixtures that hang from ceiling outlet 66. Alternatively, a ceiling fixture can be retained magnetically to top surface 16. As another alternative design, a ceiling fixture is retained by ceiling panel 64 where plug 84 of the ceiling fixture includes a top surface sufficiently larger than the aperture of ceiling panel 64 and the ceiling fixture is installed by inserting it through (downwards) the opening of ceiling panel 64 (when the ceiling panel is removed from the doll house's top surface 16) and then magnetically attaching the ceiling panel to the top surface. Moreover, although only a single ceiling outlet is shown, additional ceiling outlets may be provided. Still further, electrical outlets may be provided in the side walls and/or the rear wall of the doll house of the present invention.

Figure 10:
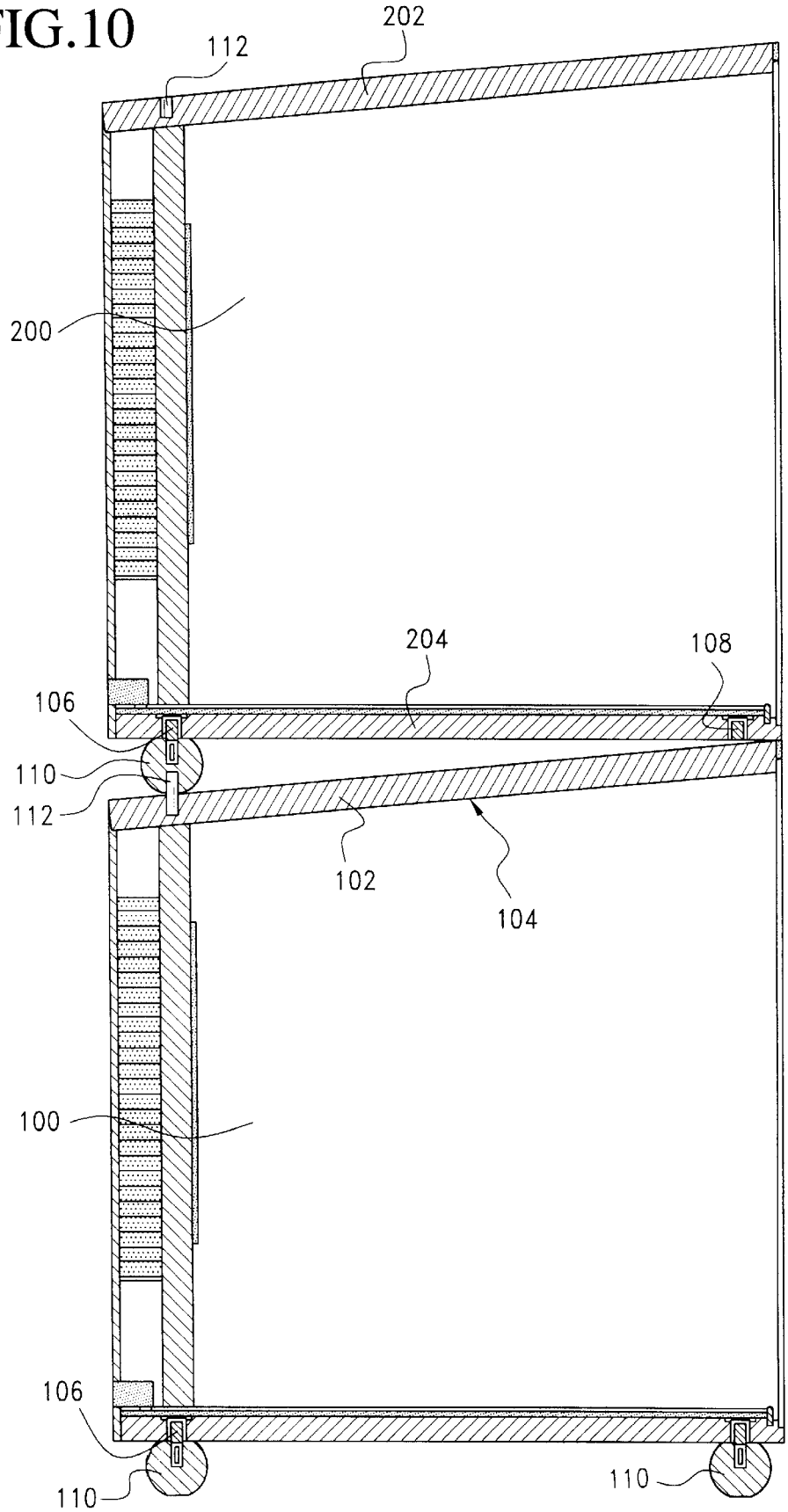
FIG. 10 illustrates two doll house rooms stacked in accordance with the present invention.

In accordance with the present invention, the doll house is shaped to allow it to be stacked with other devices, including another doll house embodying the present invention. As an example, FIG. 10 illustrates two doll houses, or rooms, coupled together or stacked in a unique manner to provide a doll house having two rooms in accordance with the present invention. Namely, a lower room 100 embodying any or all of the previously discussed features can be disposed below an upper room 200 also embodying any or all of the previously discussed features. Lower room 100 has a modular design, such as previously discussed and also shown in FIGS. 1, 2, 5, 6 and 7. As previously discussed with reference to FIGS. 1 and 2, the bottom and top surfaces of the room have a trapezoid shape so that the side surfaces slope inward towards the rear of the room to provide better viewing of the room's side walls. Also, the room's top surface (102 in FIG. 10) slopes downward towards the rear of the room so that room 100's ceiling panel 104 is more easily viewed.

To facilitate the stacking feature of the present invention, a set of rear feet is disposed between lower room 100 and upper room 200 (only the left rear foot 110 shown in FIG. 10). Feet 110 (also called ball feet herein) are appropriately sized so that the bottom surface 204 of upper room 200 is level. FIG. 10 also shows lower room 100 having four feet 110 (only left front and rear feet 110 shown) disposed below it, but such feet are not necessary to facilitate stacking.

Figure 11B:
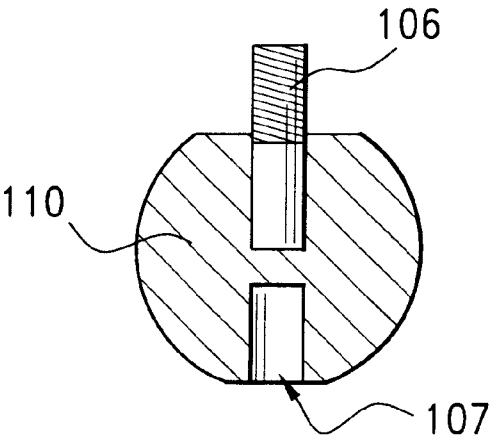
FIGS. 11A and 11B are schematic illustrations of ball feet having stacking pins used with the doll house of the present invention.
Figure 11A:
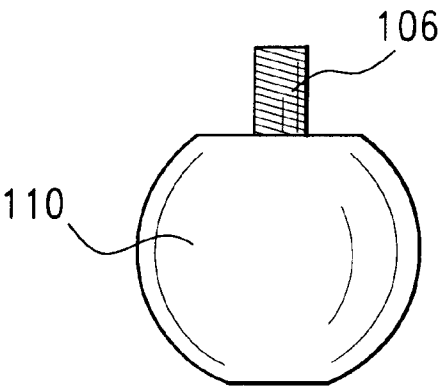
Figure 12:
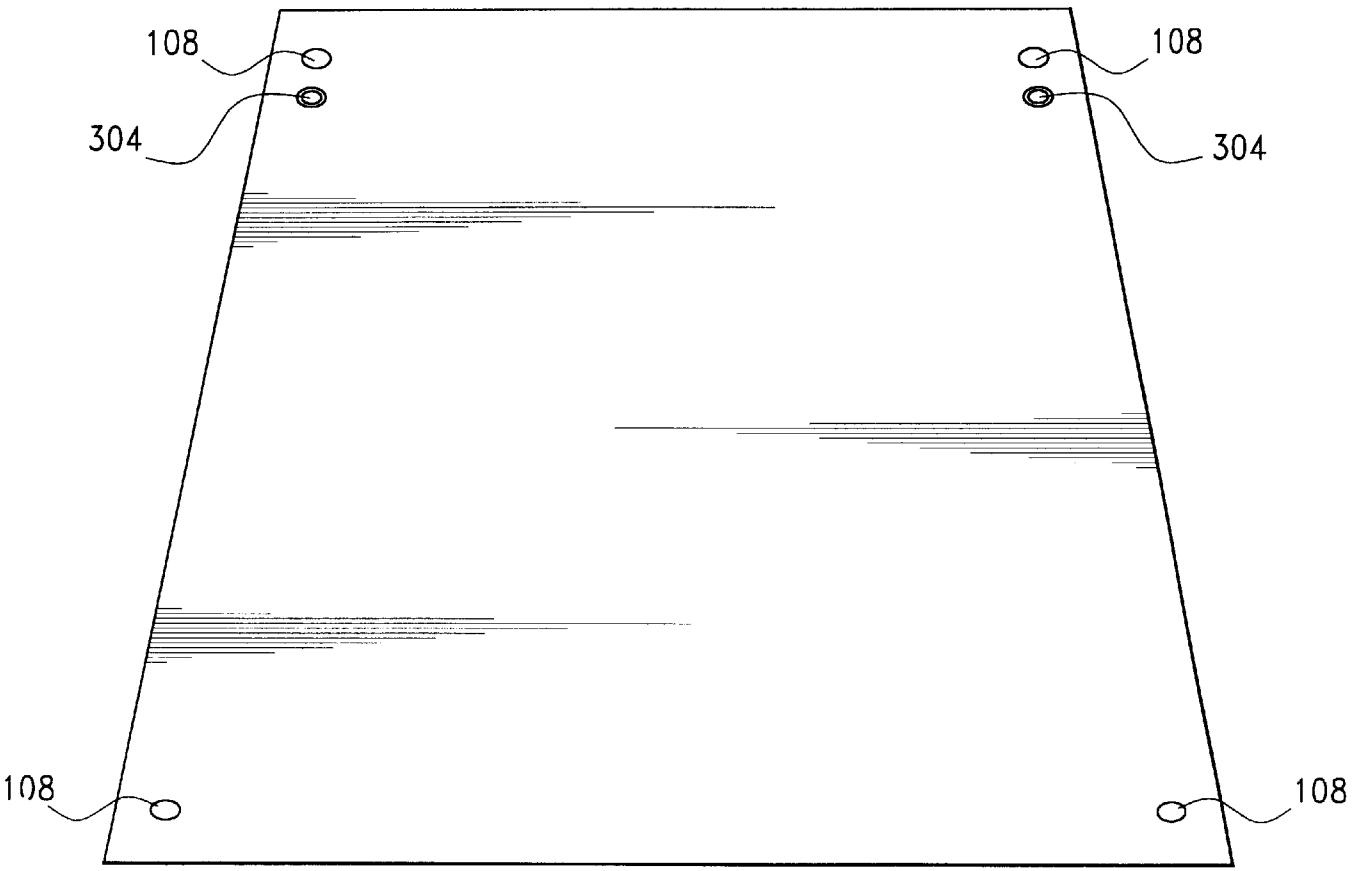
FIG. 12 illustrates positions of apertures within the bottom of the rear panel of the doll house of the present invention into which stacking pins may be installed.
Figure 13:
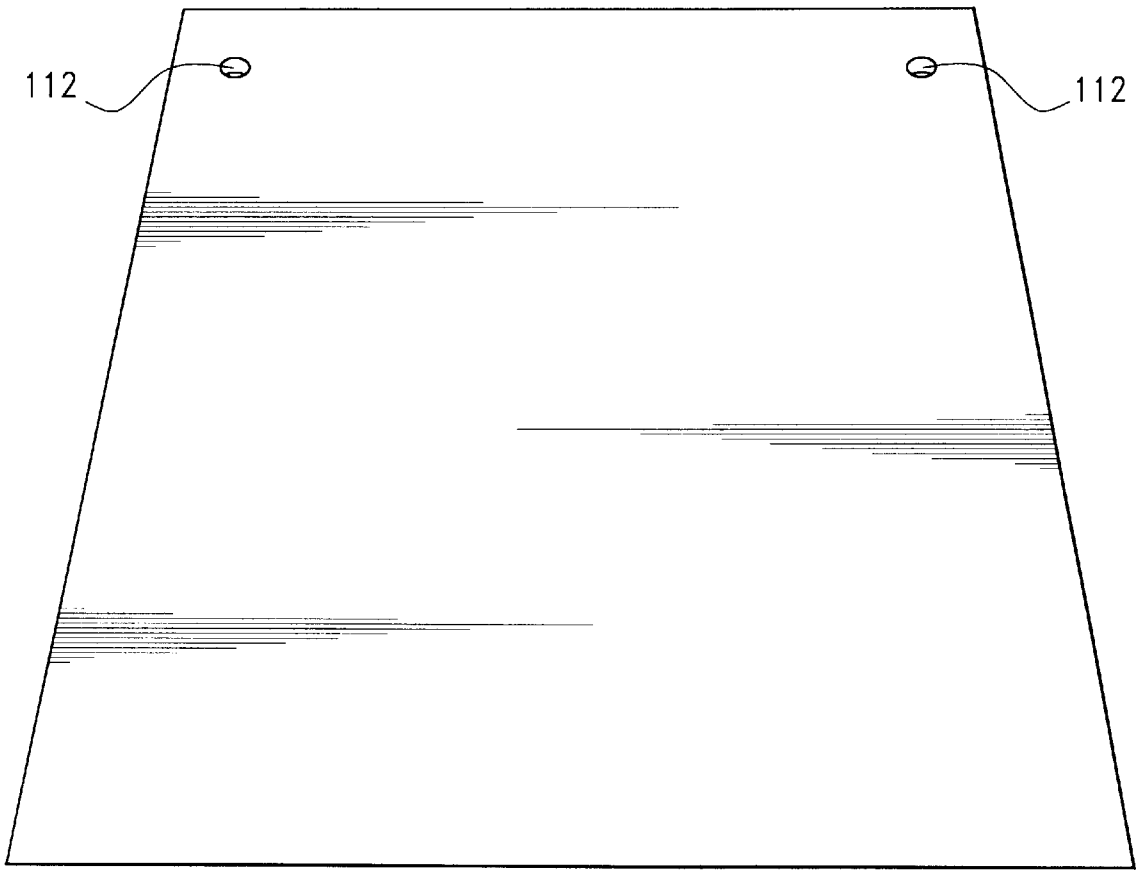
FIG. 13 illustrates positions of apertures within the top panel of the doll house of the present invention into which stacking pins may be installed.

As shown in FIGS. 11A and 11B, where FIG. 11B is a cross-sectional view, each foot 110 includes a bolt 106 extending from its top and an aperture 107 at its lower side. Bolt 106 is adapted to be screwed into any of four tee-nuts 108 disposed at the four corners of each room's lower surface, such as shown in FIG. 12. A set of holes 112 are disposed in the rear top surfaces of each room, as shown in FIG. 13, and each hole can receive one end of a stacking pin 120 (FIG. 10). Aperture 107 of each foot 110 is able to receive the other end of a respective stacking pin.

To secure upper room 200 to lower room 100, two feet 110 are screwed into the two bottom rear tee-nuts 108 of upper room 200, a stacking pin 120 is placed in each of the two installed foot, and the opposite ends of each pin is inserted into a respective hole 112 of lower room 100. Of course, additional rooms embodying the present invention may be stacked on top of upper room 200, where additional feet 110, along with stacking pins 120, are provided in the rear of the assembly between the upper surface 202 of the upper room 200 and the next room above it.

Figure 14:
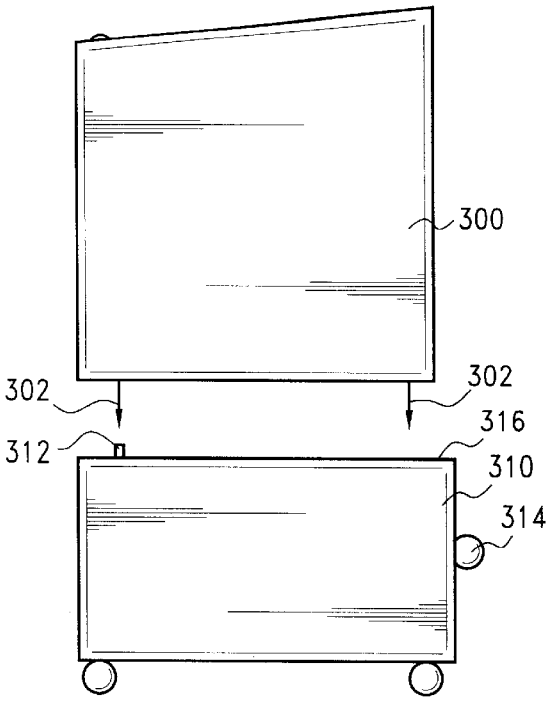
FIGS. 14 and 15 illustrate the stacking of a doll house room on a drawer unit in accordance with the present invention.
Figure 15:
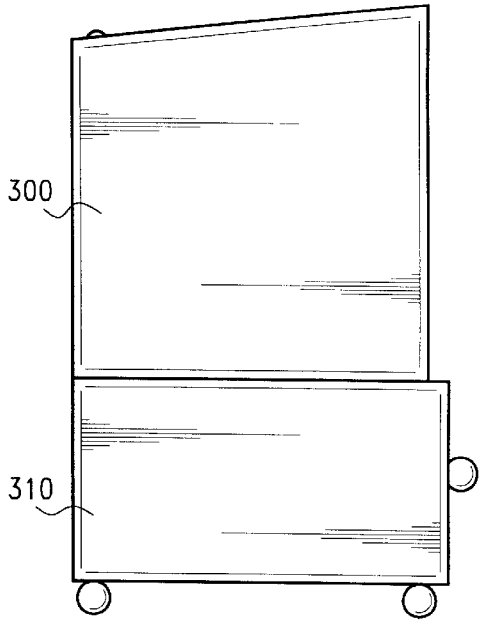

In accordance with the present invention, the herein-described room may be stacked onto or below other devices, such as a rectangular shaped drawer unit. For example, FIGS. 14 and 15 show a doll house room of the present invention stacked on top of a drawer unit.

Drawer unit 310 has a removable drawer with a knob 314 and a flat top surface 316. Room 300 embodying the doll house features previously discussed is lowered onto drawer unit 310 (represented by arrows 302). A pair of stacking pins 312 (only one shown in FIG. 14) is disposed between room 300 and drawer unit 310 to secure the components together. Drawer 310 includes a pair of apertures (not shown) and drawer 300 likewise includes a pair of apertures 304 (see FIG. 12) to receive the stacking pins.

Figure 16:
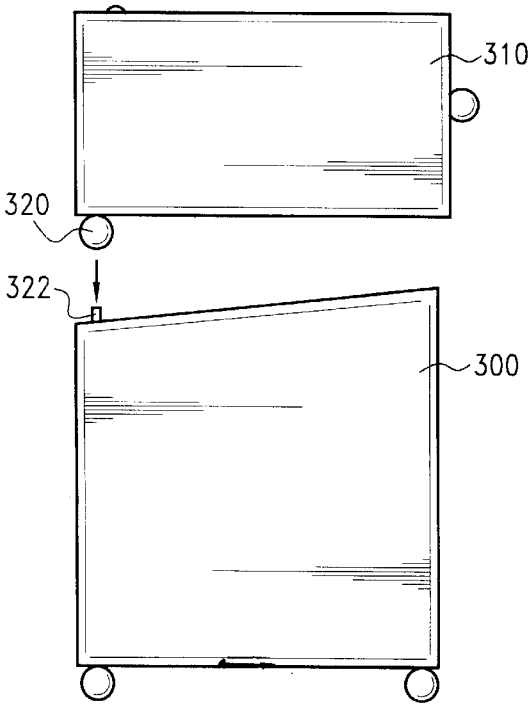
FIGS. 16 and 17 illustrate the stacking of a drawer unit on a doll house room in accordance with the present invention.
Figure 17:
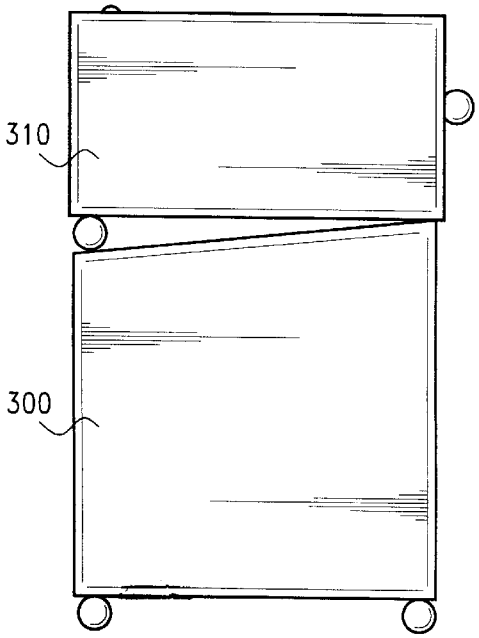

FIGS. 16 and 17 show drawer unit 310 stacked on top of room 300. Two feet 320 (only one shown in FIGS. 13 and 14) are installed in the rear bottom of drawer 310 (in a manner identical to or similar to how a foot is installed on a room) and two stacking pins 322 (only one shown) are installed into the feet and the holes of room 300 to secure drawer 310 to room 300.

Figure 18:
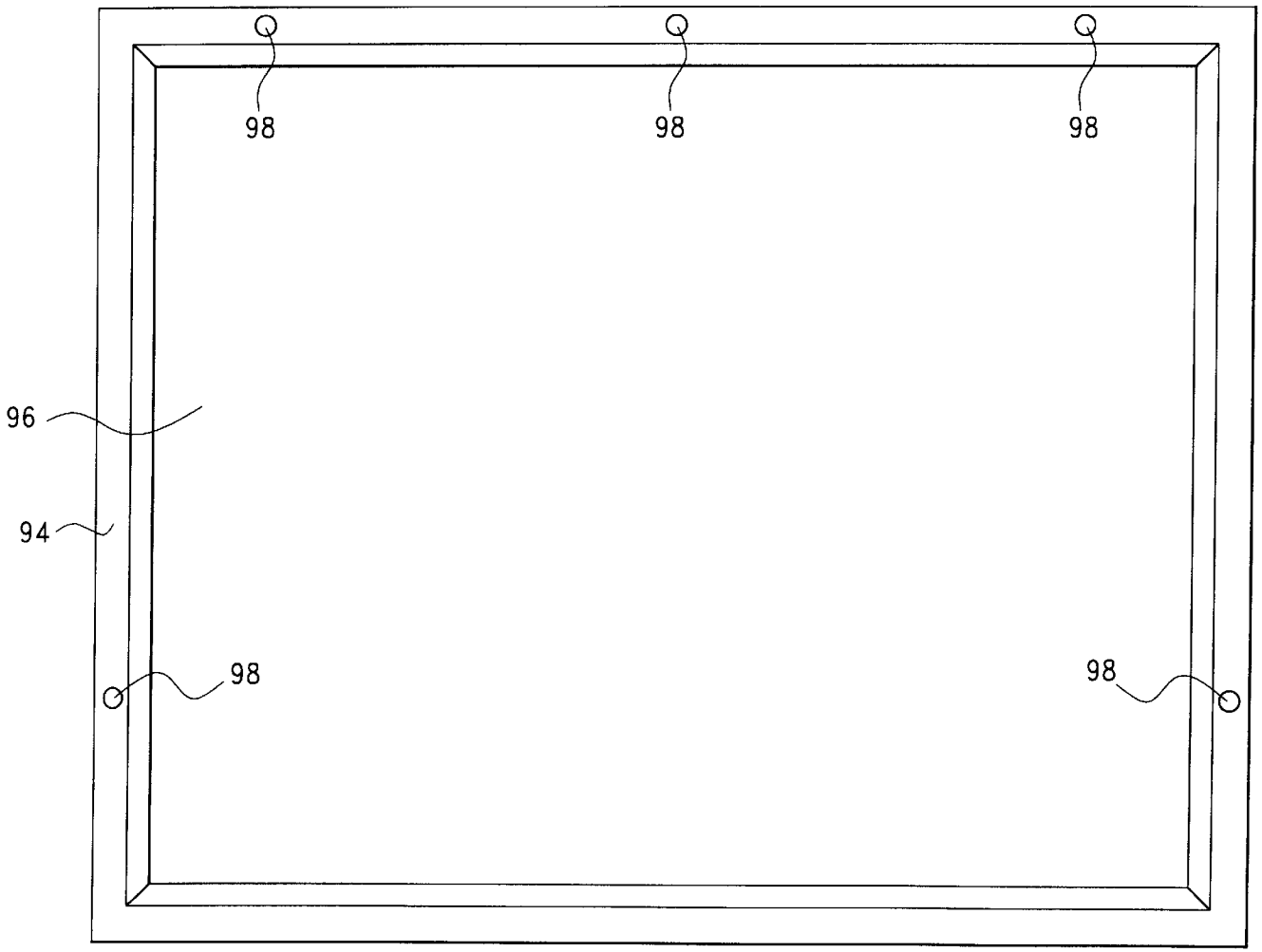
FIG. 18 schematically illustrates the dust cover used with the doll house of the present invention.
Figure 19:
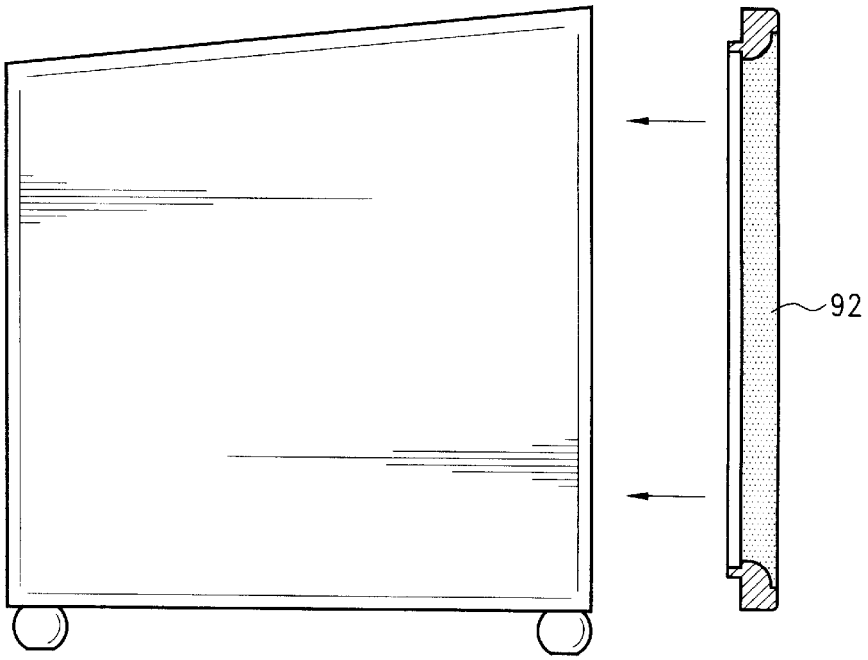
FIGS. 19 and 20 illustrate the installing of the dust cover on the doll house in accordance with the present invention.
Figure 20:
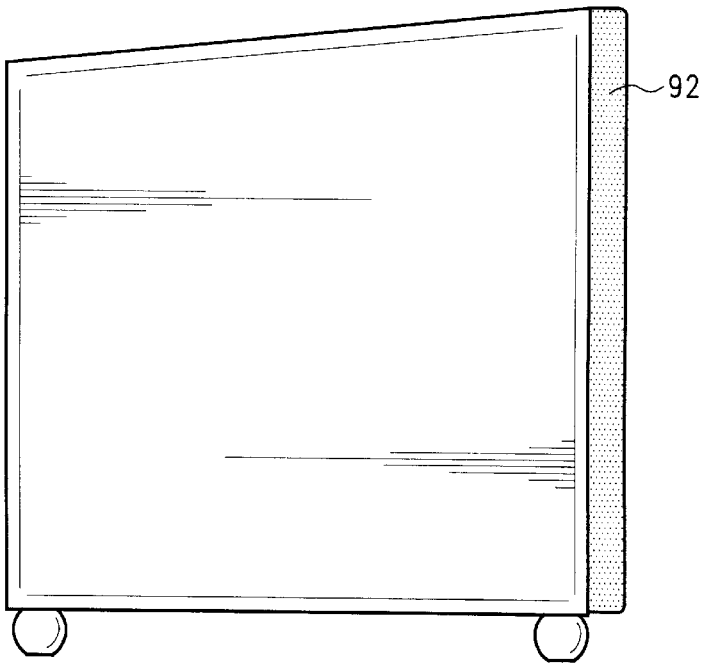

Referring back to FIG. 1, the front ends of the side and top surfaces of the doll house room of the present invention include embedded a set of metal disks 90 (five (5) shown in the exemplary embodiment). Metal disks 90 facilitate the attachment of the dust cover 92 shown in FIGS. 18, 19 and 20. Dust cover 92 includes a frame 94 that holds a clear plastic window 96, with frame 94 sized and shaped to be placed over the front opening of the doll house room of the present invention, as shown in FIGS. 19 and 20. A set of magnets 98 are disposed within the dust cover's frame 94 as positions that correspond to the positions of the metal disks 90 embedded in the doll house's front end. Magnets 98 and metal disks 90 operate to secure dust cover 92 on the doll house's open end. The dust cover then is easily removed by pulling the dust cover apart from the doll house room.

While the present invention has been particularly shown and described in conjunction with a preferred embodiment thereof, it will be readily appreciated by those of ordinary skill in the art that various changes may be made without departing from the spirit and scope of the invention. For example, the doll house includes a number of outlets and other components shown positioned at particular locations. However, such positions are merely illustrative and may be varied as desired or appropriate.

As another example, the stacking feature of the present invention has been described as enabling the stacking of two or more rooms embodying the present invention, as well as stacking of rooms on top of or below a drawer unit. However, other stacking arrangements may be possible, such as stacking a drawer on top of a room, which is stacked on another drawer, and so on.

Still yet, side, rear, ceiling and floor panels have been described as including different patterns on different sides thereof to enable a user to change the appearance of a doll house room of the present invention. However, each panel can be varied by utilizing multiple panels or various shapes and sizes. For example, each side of the room may be covered, via the magnetic panels, by lower and upper panels so that multiple patterns made by provided on an individual surface. Other variations also are possible.

Therefore, it is intended that the appended claims be interpreted as including the embodiments described herein, the alternatives mentioned above, and all equivalents thereto.

What is claimed is:

1. A doll house, comprising:

a box-like structure having a floor and a top surface, and a rear and two side walls, the structure having an open front;

a plurality of wall panels, each of the wall panels including first and second surfaces having different designs thereon;

each of the wall panels being adapted to be releasably retained by and to substantially fully cover a respective one of the rear and two side walls, and adapted to reveal a selected one of the first and second surfaces when retained by the respective one of the rear and two side walls.

2. The doll house of claim 1, wherein the first surface of each of the wall panels has the same first design thereon, and the second surface of each of the wall panels has the same second design thereon, the first design and the second design being different.

3. The doll house of claim 1, further comprising a plurality of magnetic sheets, a respective one of each of the magnetic sheets fixed to a respective one of the rear and two side walls of the box-like structure; and wherein each of the wall panels is comprised of a material magnetically attracted to the magnetic sheets.

4. The doll house of claim 1, further comprising a ceiling panel with first and second surfaces having different designs thereon; the ceiling panel being adapted to be releasably retained by and to substantially fully cover an underside of the top surface of the structure, and adapted to reveal a selected one of the first and second surfaces when retained by the top surface.

5. The doll house of claim 4, wherein the first and second surfaces of the ceiling panel have respectively same designs as the first and second surfaces of at least one of the wall panels.

6. The doll house of claim 4, further comprising a ceiling fixture releasably mountable to an underside of the top surface of the structure, the ceiling fixture extending downward from the top surface when mounted; and wherein the ceiling panel includes an aperture through which the ceiling fixture extends when the ceiling panel is retained by the top surface.

7. The doll house of claim 6, further comprising two magnetic sheets fixed to the top surface of the structure and disposed on opposite sides of a position on the top surface at which the ceiling fixture is mountable; and wherein the ceiling panel is comprised of a material magnetically attracted to the two magnetic sheets.

8. The doll house of claim 6, wherein the ceiling fixture includes a relatively flat contact end contacting the top surface when mounted, the contact end of the ceiling fixture being retained by the ceiling panel about the aperture of the ceiling panel.

9. The doll house of claim 1, further comprising a floor panel with first and second surfaces having different designs thereon; the floor panel being adapted to be positioned on and to substantially fully cover the floor, and adapted to reveal a selected one of the first and second surfaces when positioned on the floor.

10. The doll house of claim 9, further comprising a tab disposed on an end of the floor panel and adapted to enable lifting of the floor panel from the floor; and a tab disposed on an end of at least one of the wall panels and adapted to enable removal of the wall panel from the structure.

11. The doll house of claim 1, wherein the floor and top surface of the structure are trapezoidal in shape with respective smaller dimensions of the floor and top surface being at the rear wall of the structure; and the two side walls have sloped top edges sloping downward toward the rear wall so that the top surface slopes downward from the open front towards the rear wall.

12. The doll house of claim 1, further comprising a plurality of electrical outlets disposed in the floor; and wherein the floor of the structure is a printed circuit board adapted to supply a source of power to each of the electrical outlets.

13. The doll house of claim 12, wherein the rear wall of the structure is comprised of a back wall and a false wall with a gap between them, the back wall being the rear surface of the structure and the false wall positioned to receive one of the wall panels within the structure; the doll house further comprising an electrical outlet disposed in the top surface; and an electrical connection extending from the printed circuit board through the gap between the back wall and the false wall to the electrical outlet disposed in the top surface.

14. The doll house of claim 1, further comprising a protective front cover adapted to be installed over the open front of the structure, the protective front cover including a see-through surface surrounded by a frame having a plurality of magnetic components installed therein; and wherein at least the two side walls of the structure include a plurality of magnetic components installed at or near respective edges of the side walls adjacent to the open front at positions corresponding to positions at which the magnetic components are installed in the frame of the protective front cover; the magnetic components installed in the frame being attracted to corresponding magnetic components installed in the side walls of the structure to enable the protective front cover to be removably retained over the open front of the structure.

15. A doll house, comprising:

a box-like module having a floor, a top surface, a rear wall, two side walls and an open front;

the floor and top surface being trapezoidal in shape with respective smaller dimensions of the floor and top surface being at the rear wall;

each of the two side walls having sloped top edges sloping downward toward the rear wall so that the top surface slopes downward from the open front towards the rear wall; and a pair of stacking pins removably connectable to a top of the top surface near the rear wall and adapted to enable a second module having a level floor to be mounted on top of the top surface having the stacking pins connected; said stacking pins being appropriately sized to provide the floor of the second module to remain level when mounted.

16. The doll house of claim 15, further comprising a plurality of wall panels, each of the wall panels including first and second surfaces having different designs thereon; each of the wall panels being adapted to be releasably retained by and to substantially fully cover a respective one of the rear and two side walls, and adapted to reveal a selected one of the first and second surfaces when retained by the respective one of the rear and two side walls.

17. The doll house of claim 16, wherein the first surface of each of the wall panels has the same first design thereon, and the second surface of each of the wall panels has the same second design thereon, the first design and the second design being different.

18. The doll house of claim 15, further comprising said second module having the level floor, the second module being a box-like module and also having a top surface, a rear wall, two side walls and an open front; the floor and top surface of the second module being trapezoidal in shape with respective smaller dimensions being at the rear wall; each of the two side walls of the second module having sloped top edges sloping downward toward the rear wall of the second module so that the top surface slopes downward from the open front towards the rear wall; the second module being mounted on top of the top surface having the stacking pins connected.

19. The doll house of claim 18, further comprising a second pair of stacking pins removably connectable to a top of the top surface near the rear wall of the second module and adapted to enable a third module having a level floor to be mounted on top of the top surface of the second module; said stacking pins being appropriately sized to provide the floor of the third module to remain level when mounted on top of the second module.

20. The doll house of claim 15, further comprising said second module having the level floor, the second module being a drawer unit wherein the level floor is a bottom of the drawer unit; the drawer unit also having a removable drawer; the drawer unit being adapted to be mounted on top of the top surface having the stacking pins connected.

21. The doll house of claim 20, wherein the drawer unit also is adapted to be mounted below the other module.

22. The doll house of claim 15, further comprising a second pair of stacking pins; and wherein the floor of the module is adapted to receive at each corner a respective one of the stacking pins so that the received stacking pins are disposed below the module and operate as feet for the module.

23. A doll house, comprising:

first and second box-like modules; each of the first and second modules having a floor, a top surface, a rear wall, two side walls and an open front;

the floor and top surface of each of the first and second modules being trapezoidal in shape with respective smaller dimensions of the respective floor and top surface being at the respective rear wall;

each of the two side walls of each of the first and second modules having sloped top edges sloping downward toward the respective rear wall so that the top surface of each of the modules slopes downward from the respective open front towards the respective rear wall;

a plurality of stacking pins removably connectable to at least one of the first and second modules on top of the top surface near the rear wall of the respective module, the plurality of stacking pins adapted to enable one of the first and second modules to be mounted on top of the other of the first and second modules when the stacking pins are connected to said other of the first and second modules; said stacking pins being appropriately sized to provide the floor of said one of the first and second modules to be level when mounted.

* * * * *